US008656990B2

(12) United States Patent
Kajaria et al.

(10) Patent No.: US 8,656,990 B2
(45) Date of Patent: Feb. 25, 2014

(54) COLLECTION BLOCK WITH MULTI-DIRECTIONAL FLOW INLETS IN OILFIELD APPLICATIONS

(75) Inventors: Saurabh Kajaria, Houston, TX (US); Kendall Keene, Houston, TX (US)

(73) Assignee: T3 Property Holdings, Inc., Houston, TX (US)

( * ) Notice: Subject to any disclaimer, the term of this patent is extended or adjusted under 35 U.S.C. 154(b) by 260 days.

(21) Appl. No.: 13/006,283

(22) Filed: Jan. 13, 2011

(65) Prior Publication Data

US 2012/0181016 A1 Jul. 19, 2012

Related U.S. Application Data

(63) Continuation-in-part of application No. 12/631,834, filed on Dec. 6, 2009.

(60) Provisional application No. 61/231,252, filed on Aug. 4, 2009.

(51) Int. Cl.
*E21B 28/00* (2006.01)
*F16L 41/02* (2006.01)

(52) U.S. Cl.
USPC ..... 166/177.5; 166/308.1; 137/561 A

(58) Field of Classification Search
USPC ..... 166/177.5, 308.1; 137/561 R, 561 A, 884
See application file for complete search history.

(56) References Cited

U.S. PATENT DOCUMENTS

| | | | | |
|---|---|---|---|---|
| 3,934,605 | A * | 1/1976 | Legris | 137/271 |
| 4,901,563 | A | 2/1990 | Pearson | |
| 6,698,915 | B2 | 3/2004 | Dearing et al. | |
| 7,845,413 | B2 * | 12/2010 | Shampine et al. | 166/369 |

OTHER PUBLICATIONS

Demong, K. and Keene, K., "Shale Energy: Developing the Horn River", World Oil Online, vol. 231, No. 10, [retrieved from the Internet on Jan. 13, 2011 using <URL: http://www.worldoil.com/SHALE-ENERGY-Developing-the-Horn_River-Independents-and-IOCs-active-in-Horn-River-Basin-october-2010.html>].

* cited by examiner

*Primary Examiner* — Kenneth L Thompson
*Assistant Examiner* — Wei Wang
(74) *Attorney, Agent, or Firm* — Locke Lord LLP

(57) ABSTRACT

The disclosure provides a collection block that aggregates multiple incoming flow lines and provides a consolidated outgoing flow path. The collection block can be remote from a given well that is being fractured to minimize safety risk in operations around the well. The collection block has dual capabilities of being connected to individual incoming flow lines as well as to manifold systems for distributing the out flowing fluids. The one or more inlets can be formed in the collection block at an offset to a centerline of a longitudinal bore through the collection block. In some to embodiments, frac trucks can connect along an extended connection zone that provides the fluids from the truck to the collection block.

14 Claims, 9 Drawing Sheets

COLLECTION BLOCK WITH MULTI-DIRECTIONAL FLOW INLETS IN OILFIELD APPLICATIONS

CROSS REFERENCE TO RELATED APPLICATIONS

The application claims priority to and is a continuation-in-part of U.S. Non-Provisional application Ser. No. 12/631,834, filed Dec. 6, 2009, which claims the benefit of U.S. Provisional Application No. 61/231,252, filed on Aug. 4, 2009.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure generally relates oilfield applications having multiple fluid inlet lines. More particularly, the disclosure relates to oilfield applications having at least two fluid inlet lines flowing to a common point for use in fracturing operations.

2. Description of the Related Art

FIG. 1A is an exemplary schematic diagram of a prior art fracturing system for an oilfield fracturing operation. FIG. 1B is an exemplary schematic diagram of a prior art fracturing system, showing fractures in an underlying formation. FIG. 1C is an exemplary schematic diagram of the prior art fracturing system of FIG. 1A detailing a system for one well. The figures will be described in conjunction with each other. Oilfield applications often require pumping fluids into or out of drilled well bores 22 in geological formations 24. For example, hydraulic fracturing (also known as "fracing") is a process that results in the creation of fractures 26 in rocks, the goal of which is to increase the output of a well 12. Hydraulic fracturing enables the production of natural gas and oil from rock formations deep below the earth's surface (generally 5,000-20,000 feet). At such depths, there may not be sufficient porosity and permeability to allow natural gas and oil to flow from the rock into the wellbore 22 at economic rates. The fracture 26 provides a conductive path connecting a larger area of the reservoir to the well, thereby increasing the area from which natural gas and liquids can be recovered from the targeted formation. The hydraulic fracture 26 is formed by pumping a fracturing fluid into the wellbore 22 at a rate sufficient to increase the pressure downhole to a value in excess of the fracture gradient of the formation rock. The fracture fluid can be any number of fluids, ranging from water to gels, foams, nitrogen, carbon dioxide, or air in some cases. The pressure causes the formation to crack, allowing the fracturing fluid to enter and extend the crack further into the formation.

To keep the fractures open after the injection stops, propping agents are introduced into the fracturing fluid and pumped into the fractures to extend the breaks and pack them with proppants, or small spheres generally composed of quartz sand grains, ceramic spheres, or aluminum oxide pellets. The proppant is chosen to be higher in permeability than the surrounding formation, and the propped hydraulic fracture then becomes a high permeability conduit through which the formation fluids can flow to the well.

In general, hydraulic fracturing equipment used in oil and natural gas fields usually includes frac tanks with fracturing fluid coupled through hoses to a slurry blender, one or more high-pressure, high volume fracturing pumps to pump the fracturing fluid to the well, and a monitoring unit. Associated equipment includes fracturing tanks, high-pressure treating iron, a chemical additive unit (used to monitor accurately chemical addition), pipes, and gauges for flow rates, fluid density, and treating pressure. Fracturing equipment operates over a range of pressures and injection rates, and can reach up to 15,000 psi (100 MPa) and 100 barrels per minute (265 L/s). Many frac pumps are typically used at any given time to maintain the very high, required flow rates into the well.

In the exemplary prior art fracturing system 2, fracturing tanks 4A-4F (generally "4") deliver fracturing fluids to the well site and specifically to one or more blenders 8. The tanks 4 each supply the fluids typically through hoses 6A-6F (generally "6") or other conduit to one or more blenders 8. One or more proppant storage units 3 can be fluidicly coupled to the blenders 8 to provide sand or other proppant to the blenders.

Other chemicals can be delivered to the blenders for mixing. In most applications, the blenders 8 mix the fracturing fluids and proppant, and delivers the mixed fluid to one or more trucks 5A-5E (generally "5") having high-pressure pumps 9A-9F (generally "9") to provide the fluid through one or more supply lines 10A-10E (generally "10") to a well 12A (generally "12"). The fluid is flushed out of a well using a line 14 that is connected to a dump tank 16. The fracturing operations are completed on the well 12A, and can be moved to other wells 12B and 12C, if desired.

One of the significant challenges in fracturing operations is the large number of trucks, pumps, containers, hoses or other conduits, and other equipment for a fracturing system. While FIG. 1B is a graphic artist's schematic helpful for understanding larger components of a fracturing system, and FIG. 1C is helpful for schematically linking the components, the systems of FIGS. 1B and 1C are vastly simplified. The reality of a well site is shown in FIGS. 2A and 2B. The complexity and the equipment, piping, and hoses required just for one well is significant and expensive. Further, the equipment and connections are disassembled, relocated, and reassembled for the next well, further adding to increased costs for performing fracturing jobs on a field having multiple wells. The difficulty of working around the wells with the large number of components also causes safety issues.

FIG. 2A is a pictorial representation of a well site facing toward a single well, showing the equipment for fracturing the well including a conglomeration of multiple blenders, pumps, piping, hoses, and other lines. FIG. 2B is a pictorial representation of the well site shown in FIG. 2A taken from the well facing outward to the equipment. The figures will be described in conjunction with each other. The blenders 8 provide the mixed fluids through several blender lines 11 to a trailer 20 having a low-pressure input line 21 that aggregates the fluid from the blender lines. The low-pressure input line 21 flows the fluid into a low pressure outline 23 from which several pump input lines 25 coupled thereto receive the fluid and deliver the fluid to the high-pressure pumps 9. The pumps 9 provide high-pressure fluid through a pump output line 27 to a high-pressure input line 28 on the trailer 20. Several supply lines 10, coupled to the high-pressure input line 28, deliver fluid to the well 12 for the fracturing. Some supply lines have further connections to high-pressure pump output lines to increase capacity adding to the complexity of the piping system. For example, as shown in FIG. 2B, a supply line 10A is also coupled directly with a pump output line 27A and supply line 10B is also coupled directly with a pump output line 27B.

Recently, efforts in the industry have been directed to more efficiently fracture multiple wells at a given field. The number of assembled equipment components has raised even further the complexity level of the system and the ability to operate in and around the multiple wells. One need for an improved system is to provide a better transfer of the fluid from the many sources to the well.

BRIEF SUMMARY OF THE INVENTION

The disclosure provides a collection block that aggregates multiple incoming flow lines and provides a consolidated outgoing flow path. The collection block can be remote from a given well that is being fractured to minimize safety risk in operations around the well. The collection block has dual capabilities of being connected to individual incoming flow lines as well as to manifold systems for distributing the out flowing fluids. The one or more inlets can be formed in the collection block at an offset to a centerline of a longitudinal bore through the collection block. In some embodiments, frac trucks can connect along an extended connection zone that provides the fluids from the truck to the collection block.

The disclosure provides a fracturing system for oilfield applications, comprising: a first collection block having a first face and a second face and a first end and a second end with a longitudinal bore through the collection block between the ends, the longitudinal bore establishing a longitudinal centerline, the collection block further having at least one outlet and a plurality of inlets, each inlet having an inlet bore disposed through the first face to intersect the longitudinal bore and one or more of the inlet bores being offset by a distance from the centerline to cause the one or more inlet bores to tangentially intersect the longitudinal bore.

DETAILED DESCRIPTION

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an "A or "B" to designate one member of a series of elements, or to describe a portion of an element. When referring generally to such elements, the number without the letter can be used. Further, such designations do not limit the number of elements that can be used for that function.

The disclosure provides a collection block that aggregates multiple incoming flow lines and provides a consolidated outgoing flow path. The collection block can be remote from a given well that is being fractured to minimize safety risk in operations around the well. The collection block has dual capabilities of being connected to individual incoming flow lines as well as to manifold systems for distributing the out flowing fluids. The one or more inlets can be formed in the collection block at an offset to a centerline of a longitudinal bore through the collection block. In some embodiments, frac trucks can connect along an extended connection zone that provides the fluids from the truck to the collection block.

Figure 3:
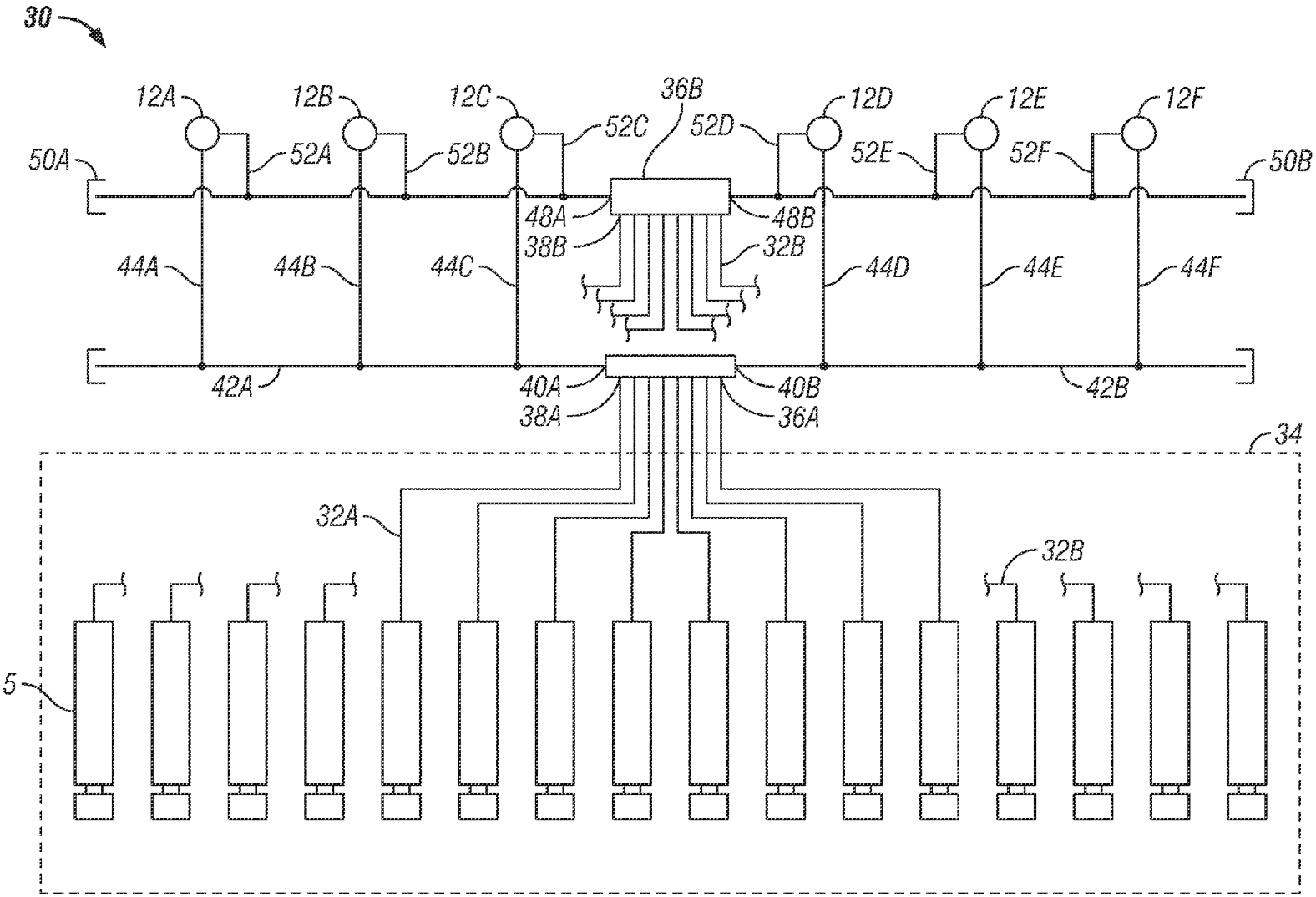
FIG. 3 is an exemplary schematic diagram of a fracturing system benefitting from the collection block of the present invention configured to accept multiple incoming supply lines.

FIG. 3 is an exemplary schematic diagram of a fracturing system benefiting from the collection block of the present invention. The fracturing system 30 generally includes supply lines, collection blocks, manifolds for an output of the collection blocks, and well lines from the manifolds to the wells. More specifically, the system can include a truck connection zone 34 in which a plurality of trucks 5 containing fracturing fluids can be coupled to a plurality of supply lines, such as lines 32A, 32B (generally lines 32). The coupling occurs remote from one or more collection blocks 36A, 36B (generally, collection block 36) and particularly from the one or more wells 12A through 12F (generally, well 12).

Figure 1A:
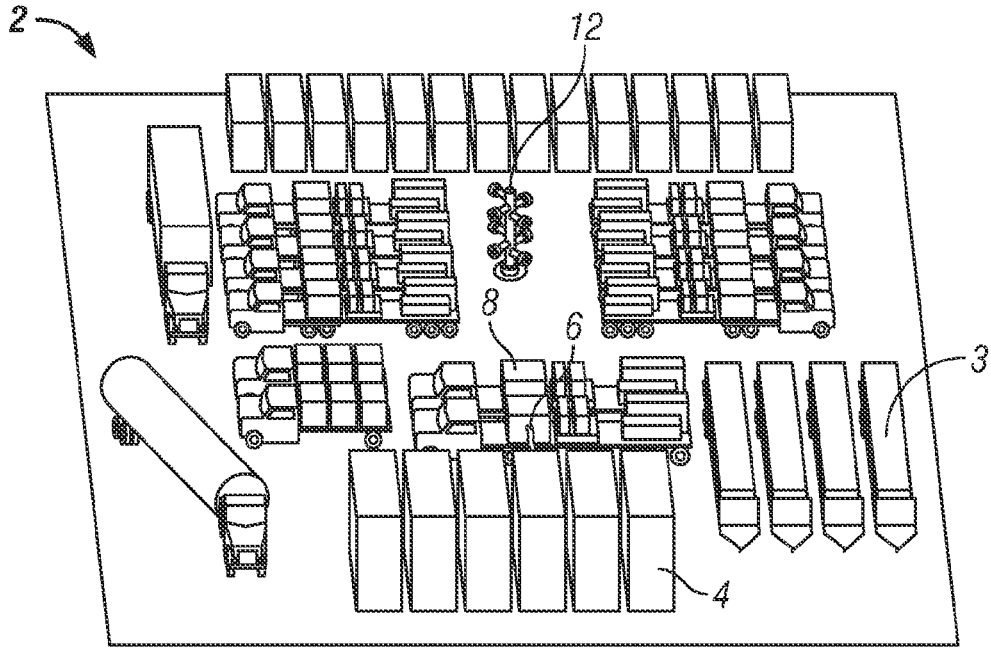
FIG. 1A (Prior Art)
FIG. 1A is an exemplary schematic diagram of a prior art fracturing system for an oilfield fracturing operation.
Figure 1B:
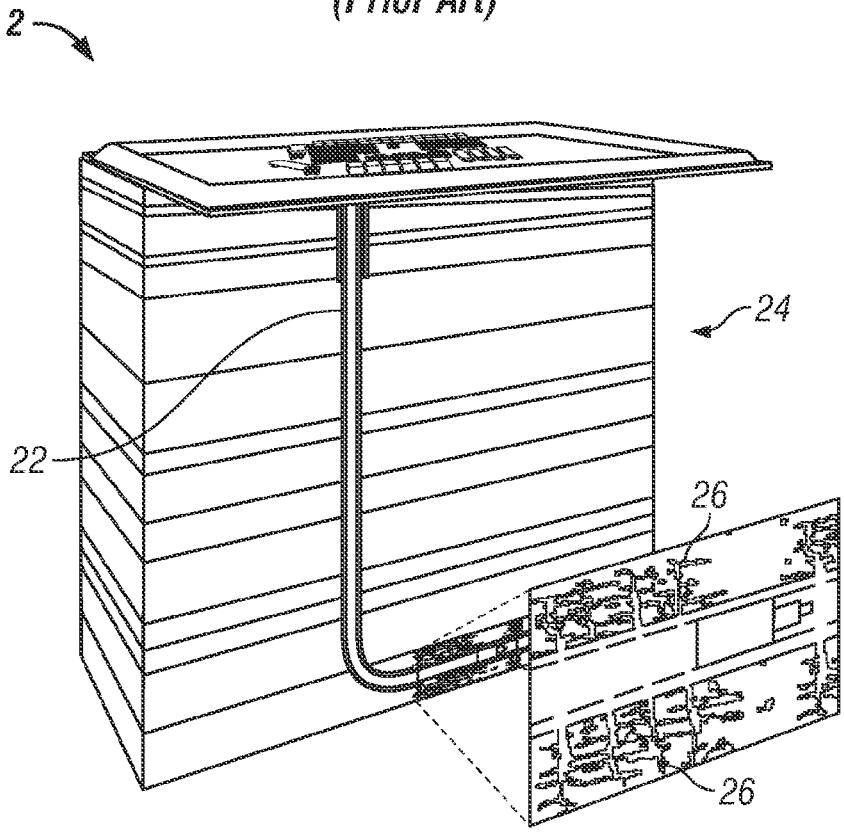
FIG. 1B (Prior Art)
FIG. 1B is an exemplary schematic diagram of a prior art fracturing system, showing fractures in an underlying formation.
Figure 1C:
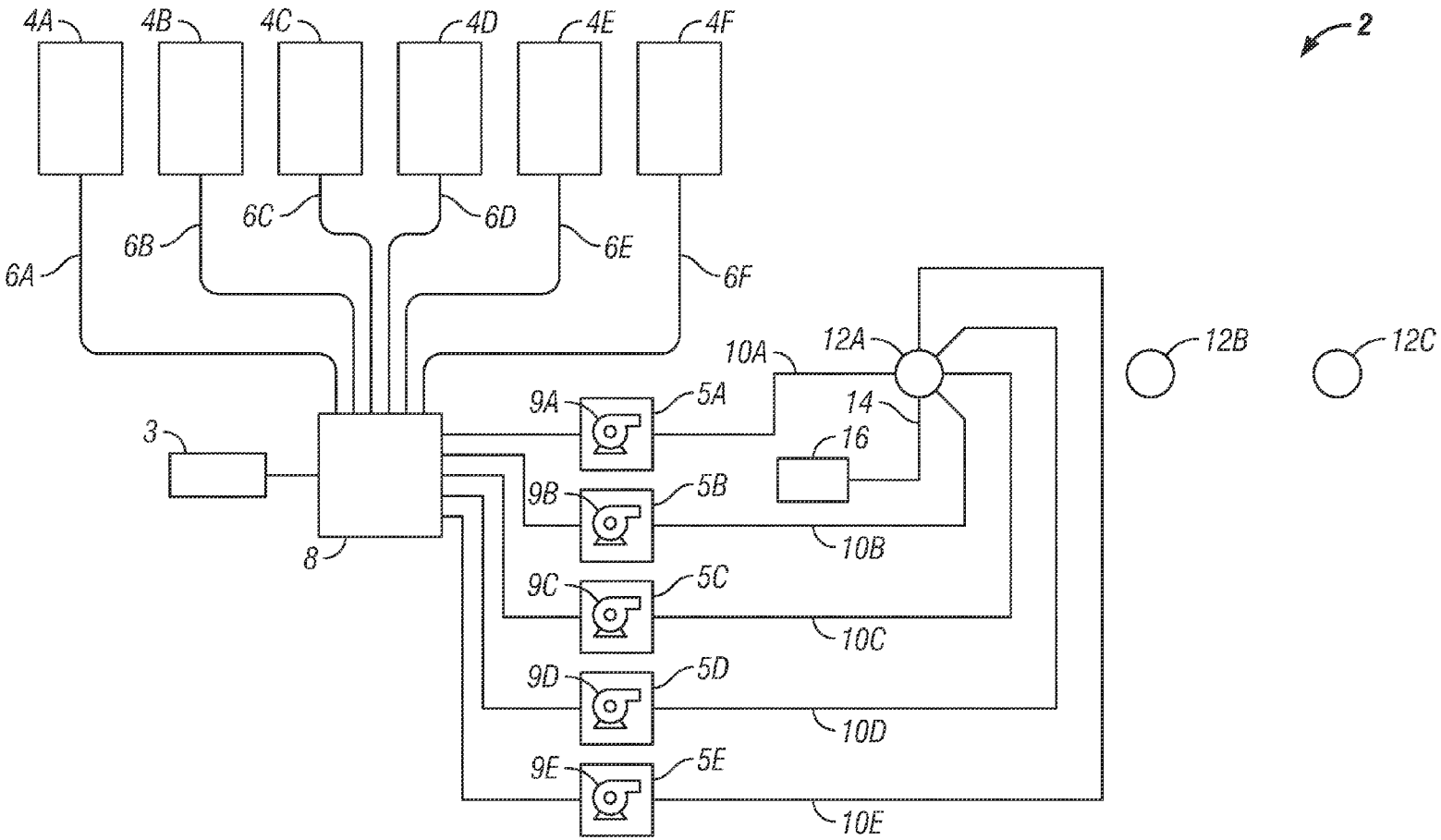
FIG. 1C (Prior Art)
FIG. 1C is an exemplary schematic diagram of the prior art fracturing system of FIG. 1A detailing a system for one well.
Figure 2A:
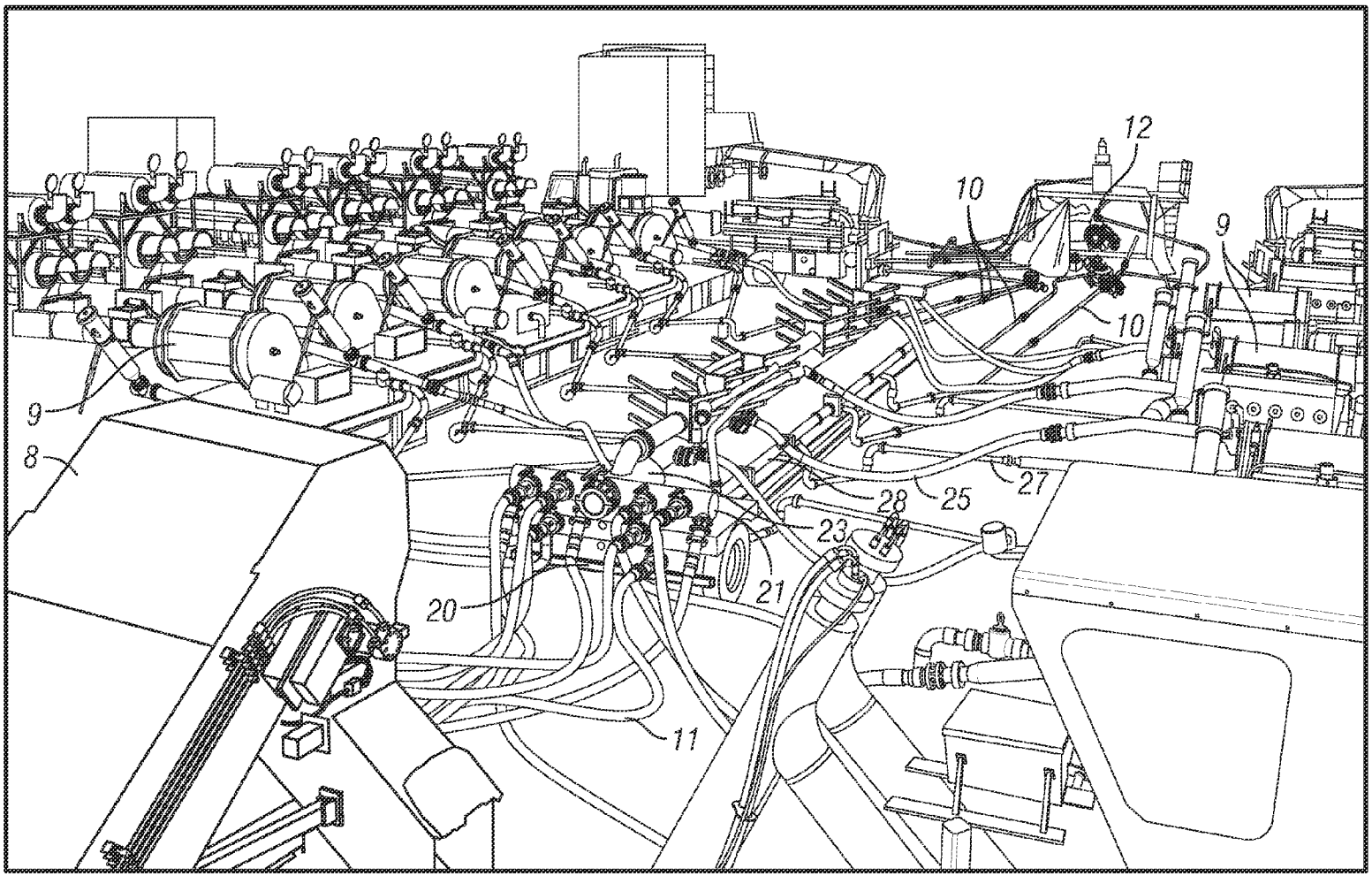
FIG. 2A (Prior Art)
FIG. 2A is a pictorial representation of a well site facing toward a single well, showing the equipment for fracturing the well including a conglomeration of multiple blenders, pumps, piping, hoses, and other lines.
Figure 2B:
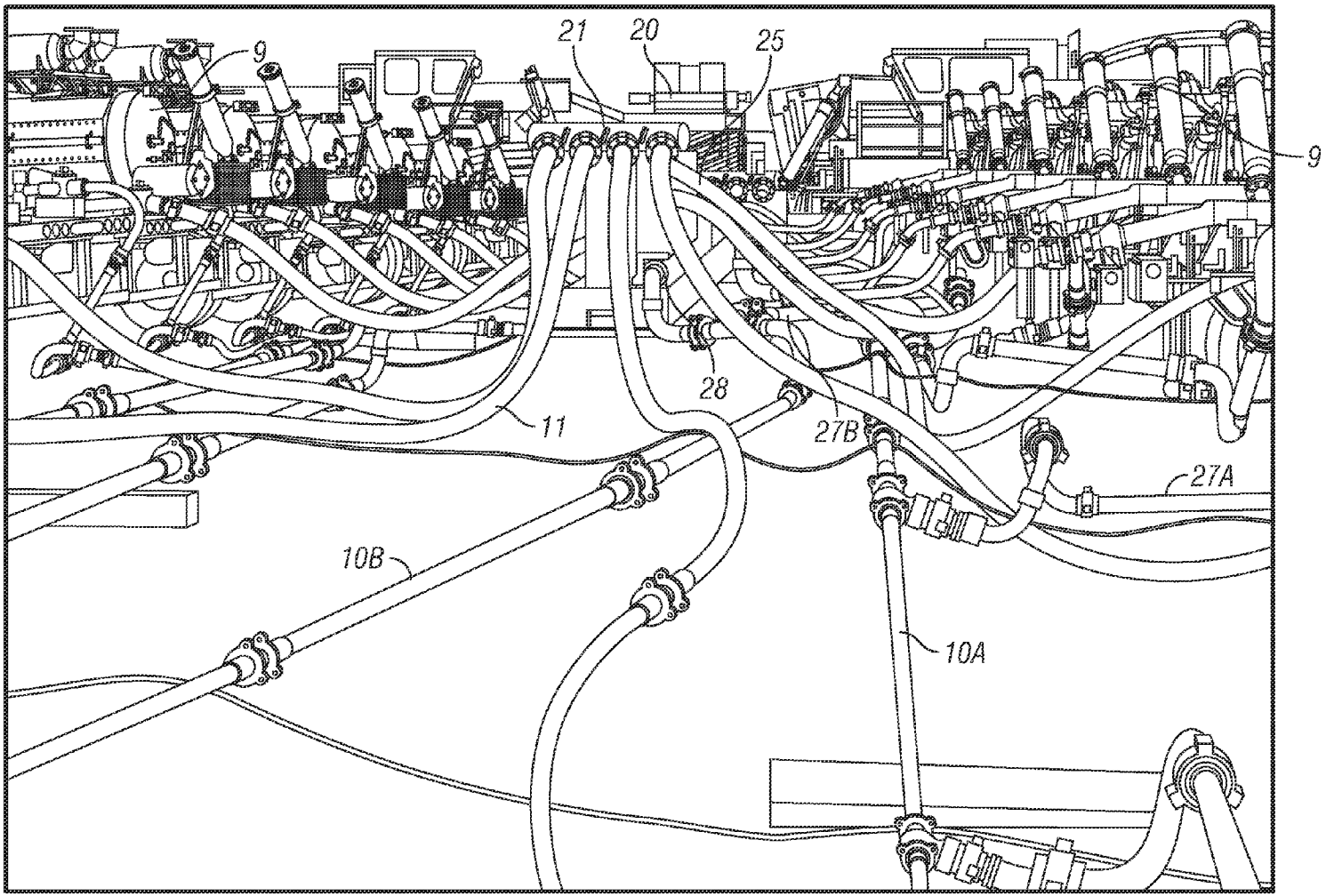
FIG. 2B (Prior Art)
FIG. 2B is a pictorial representation of the well site shown in FIG. 2A taken from the well facing outward to the equipment.

This improved system differs from a conventional system shown in FIGS. 2A and 2B in that the connections to tanks, trucks, and pumps are remote from the well to minimize the number of lines going to the well. In the embodiment shown, the number of lines going to the well 12 is two for two types of fluids from two manifolds, but could be just one line using one type of fluid. This system radically differs from the conventional system shown in FIGS. 2A and 2B. This system is believed to be easier to work around the wells during the fracturing operations.

The supply lines 32A are directed to a first collection block 36A. The lines 32A enter the collection block 36A through a plurality of inlets 38A. The number of inlets can vary from one to many and generally will be at least two.

The collection block 36A can have one or more outlets 40A, 40B (generally, outlet 40) that in turn are coupled to one or more manifolds 42A, 42B (generally, manifold 42). In at least one embodiment, the outlet 40A is disposed on a first end of the collection block, and the outlet 40B disposed on a second end of the collection block, distal from the first end. The outlet 40A can be coupled to the manifold 42A. The manifold 42A can in turn be coupled to one or more well lines 44A, 44B, 44C (generally well lines 44) that can supply fracturing fluid to the wells 12A, 12B, 12C, respectively. Similarly, the second outlet 40B on the second end of the collection block 36A can be coupled to the second manifold 42B. The manifold 42B can be coupled to a plurality of well lines 44D, 44E, 44F to supply fluid to the wells 12D, 12E, 12F, respectively.

In some embodiments, a plurality of collection blocks can be used with their respective incoming supply lines and outlets. For example, a second collection block 36B can receive fluid from the trucks 5 through one or more supply lines 32B into one or more inlets 38B of the collection block 36B. The collection block 36B can include an outlet 48A disposed on a first end of the collection block 36B, and an outlet 48B disposed on a second end of the collection block distal from the first end. The outlets can in turn be coupled to one or more manifolds 50A, 50B (generally, manifold 50), respectively. The manifolds 50A, 50B can be coupled to one or more well lines 52A through 52F (generally, well lines 52) for coupling to the one or more wells 12A through 12F, respectively. The second collection block 36B can supply a different or same fluid than the collection block 36A. Thus, at each well 12, the number of lines attached to the well is significantly reduced from the number of supply lines from the trucks. The system offers a less obtrusive, more manageable work area with increased safety.

Figure 4A:
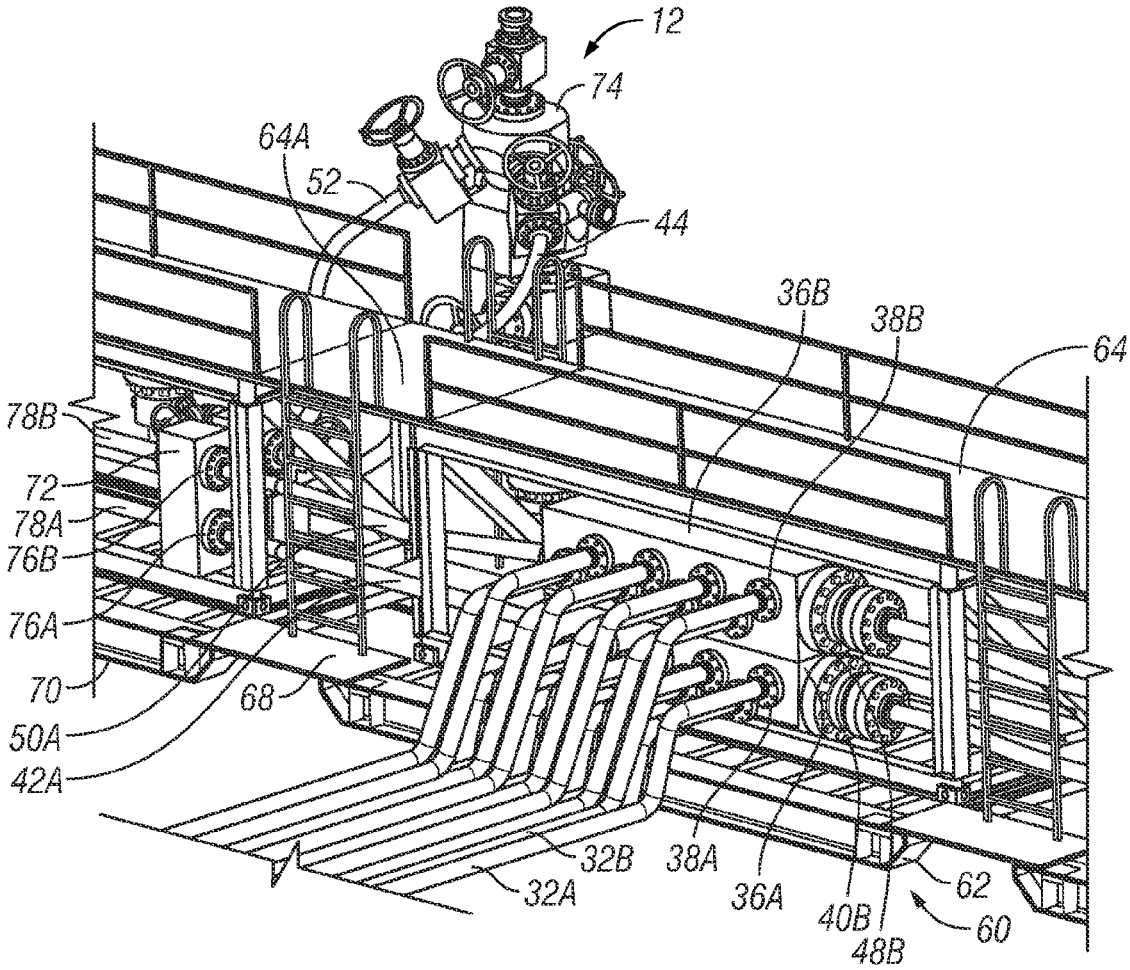
FIG. 4A is a top perspective schematic view of a portion of the fracturing system of FIG. 3 with a modular collection block skid having one or more collection blocks mounted thereon, according to the present invention.
Figure 4B:
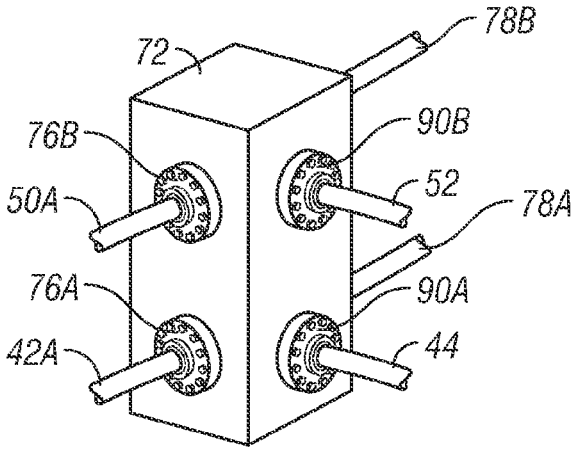
FIG. 4B is a back perspective schematic view of the Tee block illustrated in FIG. 4A.

FIG. 4A is a top perspective schematic view of a portion of the fracturing system of FIG. 3 with a modular collection block skid having one or more collection blocks mounted thereon, according to the present invention. FIG. 4B is a back perspective schematic view of the Tee block illustrated in FIG. 4A. The figures will be described in conjunction with each other. To facilitate the fracturing system 30, the fracturing system can be divided into modules. The modules can be mounted on skids for increased sufficiency in setups, takedowns, and removal to other well sites.

In general, the supply lines 32A provide fracturing fluid from the trucks 5, described above. The supply lines 32A are coupled to the collection block 36A. Due to the number of supply lines, the supply lines may be offset from each other to provide increased compactness of the assembly. The collection block 36A can have an outlet 40B that can be coupled to a manifold 42B for supplying fluid ultimately to one or more wells 12. Similarly, another set of supply lines 32B can supply fluids to the collection block 36B. The collection block 36B can have one or more outlets 40B that can be coupled to a manifold 48B for supplying a second fluid to the one or more wells 12. The structure can be mounted on a skid 60 having a frame 62 with generally horizontal and vertical members to form the frame structure. The skid 60 can further include a walkway 64 and a guardrail 66 for access above the frame structure, collection block, assemblies, lines, and other items. Further, the walkway 64 can include a transition walkway 64A to provide access across multiple skids of the fracturing system 30. A ladder 68 can be used to allow ease of access to the walkway 64.

Another outlet 40A, as described in FIG. 3, is disposed on the collection block 36A distal from the outlet 40B. The outlet 40A can be coupled to another manifold 42A for providing fluid ultimately to one or more wells 12. Similarly, the collection block 36B can include an outlet 48A, described in FIG. 3, distal from the end with the outlet 48B of the collection block. The outlet 48A can be coupled to a manifold 50A that can supply a second fluid to the one or more wells 12.

A second skid, herein a "Tee" skid, can be used to provide further piping and lines for directing flow ultimately to the well 12. Specifically, the Tee skid 70 can provide a Tee block 72 mounted thereon having an inlet 76A and an outlet 78A. The Tee block 72 can further include a branch outlet 90A, shown in FIG. 4B. The branch outlet 90 can be coupled to a well line 44, described in FIG. 3, for providing fluid to the well 12. The line 44 can be coupled to a goat head 74 above the well. The outlet 78A of the block 72 can provide fluid to a next skid with a next Tee block that can be coupled to the next well line 44 for supplying fluid to the next well. While the term "Tee" is used, it is understood that such term can apply to an elbow, such as might exist at an end of the manifold, or a cross that might provide an additional outlet (or inlet).

Similarly, the Tee block 72 can include another inlet 76B for the manifold 50A to be coupled thereto. A corresponding outlet 78B can provide the fluid from the Tee block 72 to another portion of the manifold 50A for providing fluid to other flow elements, such as another Tee block for another well. The Tee block 72 can provide another branch outlet 90B that can be coupled to the well line 52 described in FIG. 3 for supplying fluid to the well 12. The other end of the well line 52 can be coupled to the goat head 74 to be mixed with fluid in the well line 44 before supplying to the well 12. Thus, the system provides an efficient plan for providing fluid to the wells using the collection block for incoming fluid and distribution to multiple wells with outflowing fluid.

Figure 4C:
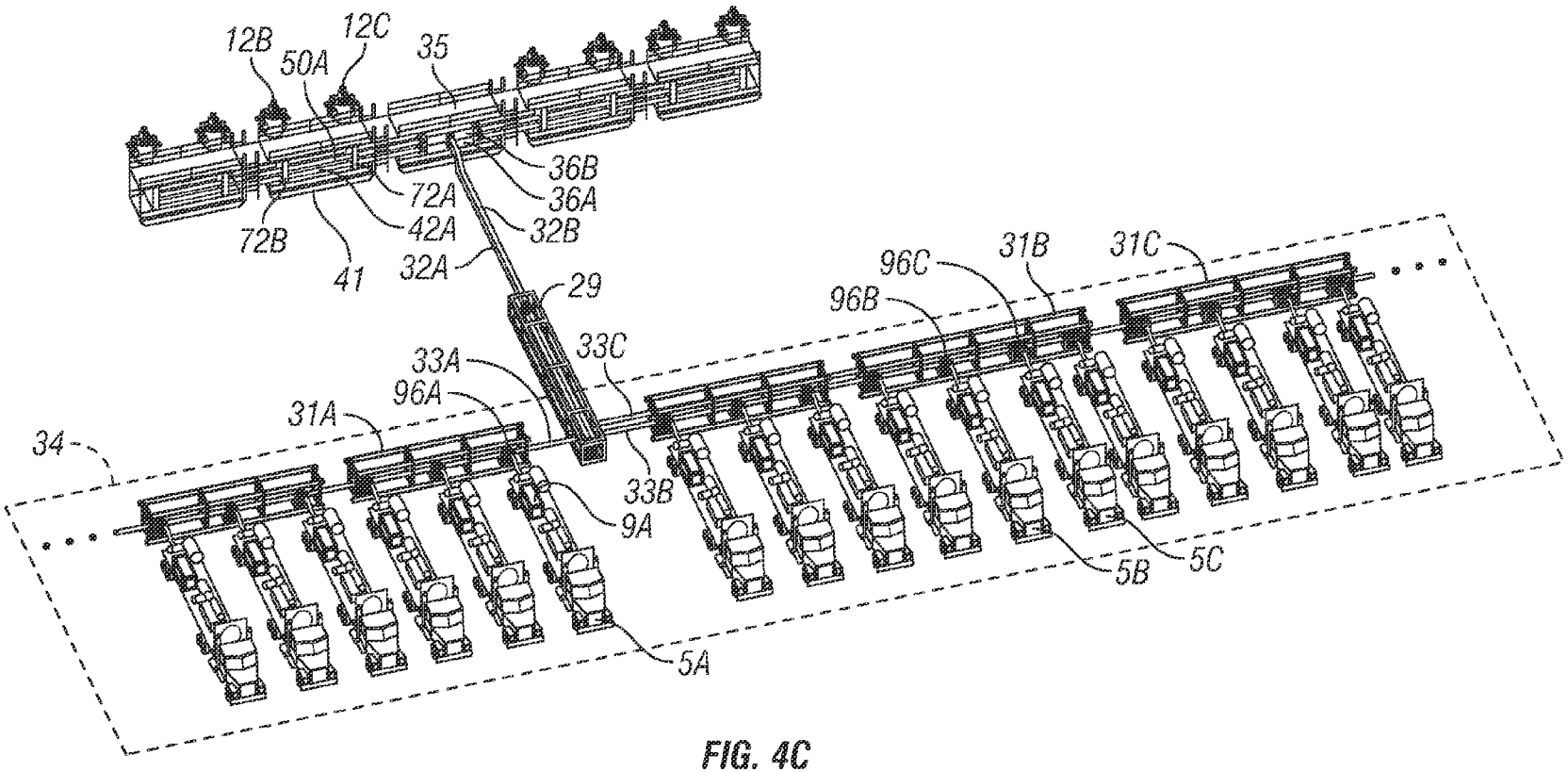
FIG. 4C is a top perspective schematic view of a fracturing system benefiting from the collection block of the present invention with the collection block configured to accept a single incoming supply line from the pumps.

FIG. 4C is a top perspective schematic view of a fracturing system benefiting from the collection block of the present invention with the collection block configured to accept a single incoming supply line from the pumps. In some embodiments, the fracturing fluids can be provided to a modular fracturing system 30 prior to the collection block 36, so that the collection block can be coupled to one incoming supply line 32 to provide the fluid to the one or more manifolds 42, 50, described above. The modular system includes a connection zone 34 in which trucks 5 can connect to one or more supply modules 31A, 31B, 31C (generally "31") for providing fluid to supply line 32 and ultimately to the wells 12. The supply modules 31 each have supply blocks 96A, 96B, 96C (generally "96") that fluidicly can function as ells, tees, or crosses that are fluidicly coupled to one or more supply manifolds 33A, 33B, 33C (generally "33"). The trucks 5 can be equipped with pumps 9 to provide the fluid at high pressure sufficient for fracturing to the supply manifolds 33. For example, the truck 5A can provide fracturing fluid through the pump 9A into the supply block 96A mounted on the supply module 31A to flow the fluid into the supply manifold 33A. The truck 5B can provide fracturing fluid through its pump into the supply block 96B mounted on the supply module 31B to flow the fluid into the supply manifold 33B. The supply manifolds 33A, 33B can be fluidicly coupled at a transition module 29 to combine their manifold flows into the supply line 32A that flows into the collection block 36A. The flow into the collection block 36A mounted on a collection module 35 can be distributed into the manifold 42 coupled to one or more distribution modules 41 for each of the wells 12, as described above.

Similarly, the truck 5C can provide fracturing fluid through its pump into the supply block 96C mounted on the supply module 31B (which may also include the supply block 96B) to flow the fluid into the supply manifold 33C. Other trucks can supply their fluid into other supply blocks fluidicly coupled to the supply manifold 33C on the supply module 31C. The supply manifold 33C can be coupled to the supply line 32A at the transition module 29 to flow fluid into the collection block 36B mounted on the collection module 35. The flow into the collection block 36B can be distributed into the manifold 50 for each of the wells 12, as described above.

In at least one embodiment, the collection block 36 can provide the versatility of one or many supply lines coupled thereto, such as shown in FIGS. 3 and 4A, by having a plurality of inlets on one face, and a different inlet on another face, such as shown in FIG. 4C. Details of the collection block 36 are described in the following figures.

Figure 5:
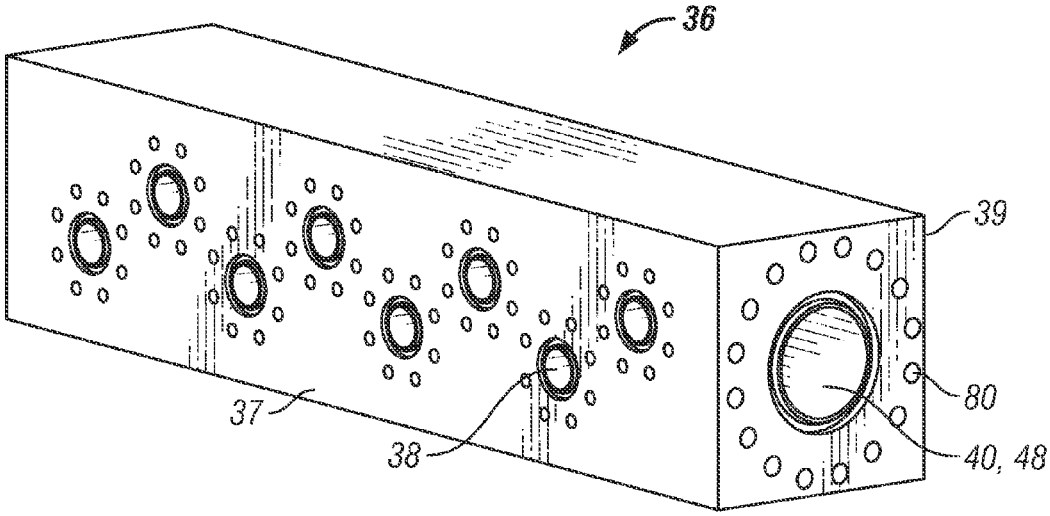
FIG. 5 is a top perspective schematic view of the collection block illustrated in FIG. 4.
Figure 6:
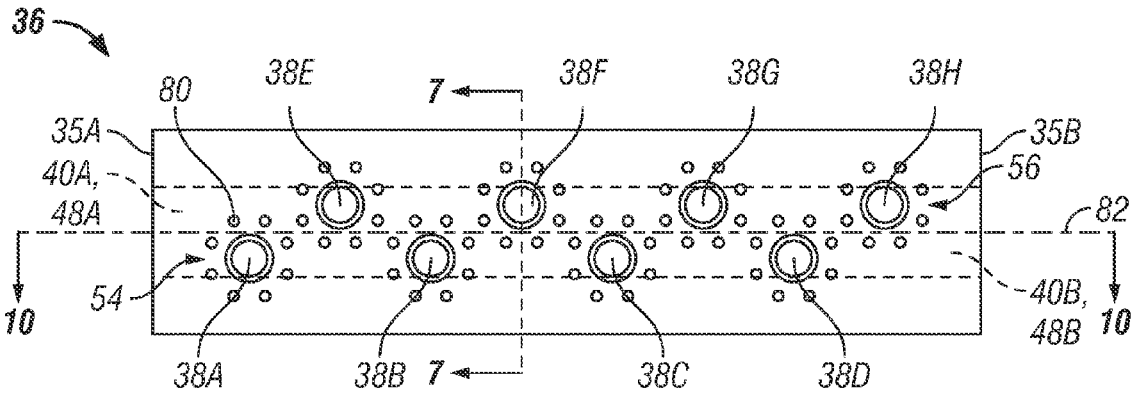
FIG. 6 is a front schematic view of the collection block illustrated in FIG. 5.
Figure 7:
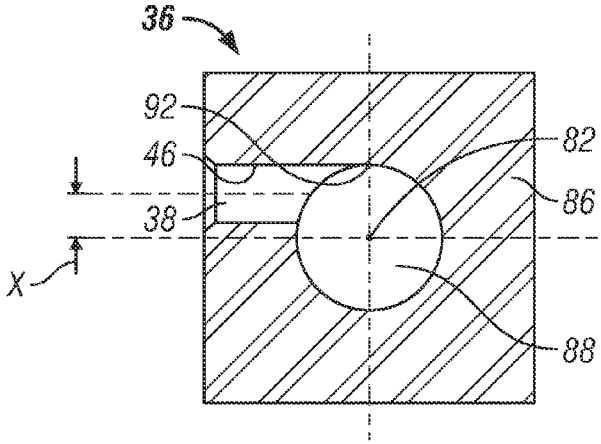
FIG. 7 is a side cross-sectional schematic view of the collection block illustrated in FIG. 6.

FIG. 5 is a top perspective schematic view of the collection block illustrated in FIG. 4. FIG. 6 is a front schematic view of the collection block illustrated in FIG. 5. FIG. 7 is a side cross-sectional schematic view of the collection block illustrated in FIG. 6. The figures will be described in conjunction with each other. The collection block 36 can include one or more inlets 38 disposed on a face 37 of the collection block. The multiple inlets shown on the face 37 can be used to couple the several supply lines to the collection block, as shown in FIG. 4A. The collection block 36 can also include an inlet 84 on another face 39 that can be used to couple the supply line to the collection block, as shown in FIG. 4C. For multiple inlets, the inlets 38 can be offset from each other for a more compact assembly. An attachment means 80, such as bolt holes for coupling flanges, threads, quick connects, and other attachment methods can be used to couple supply lines to the collection block 36. A plurality of inlets is shown with the understanding that the number can vary.

In the illustrated embodiment, the inlets can be offset from a centerline of a longitudinal bore through the collection block. If the inlets are sufficient in number, the inlets can be aligned into multiple rows, for example, a first row below the centerline and a second row above the centerline. A first row 54 of inlets 38A-38D can be offset from a longitudinal centerline 82 by a distance X from the centerline 82 of a longitudinal bore 88 through the collection block 36. In at least one embodiment, a bottom portion of one or more inlet walls 46 of the inlets 38A-38D that is distal from the centerline 82 can be tangentially aligned and intersect a bottom portion of a wall 92 of the longitudinal bore 88. The bottom portions of the walls 46, 92 merge, as shown particularly in FIG. 7. The tangential intersection between the one or more walls 46 of the inlets 38A-38D and the wall 92 of the bore 88 can provide improved flow, less erosion, or other potential advantages. In a corresponding manner, a second row 56 of inlets 38E through 38H can be offset above the centerline 82 by a similar offset distance that is opposite from the offset distance X of the first row 54 relative to the centerline 82. The offset for the second row 56 will allow a top portion of one or more of the walls 46 of the inlets 38E-38H that is distal from the centerline 82 and the top of the wall 92 of the collection bore 88 in the collection block 36 to tangentially merge. The longitudinal bore terminates at the outlet 40A, 48A shown in FIGS. 3 and 4A on one end 35A, and the outlet 40B, 48B on the second end 35B distal from the first end.

Figure 8:
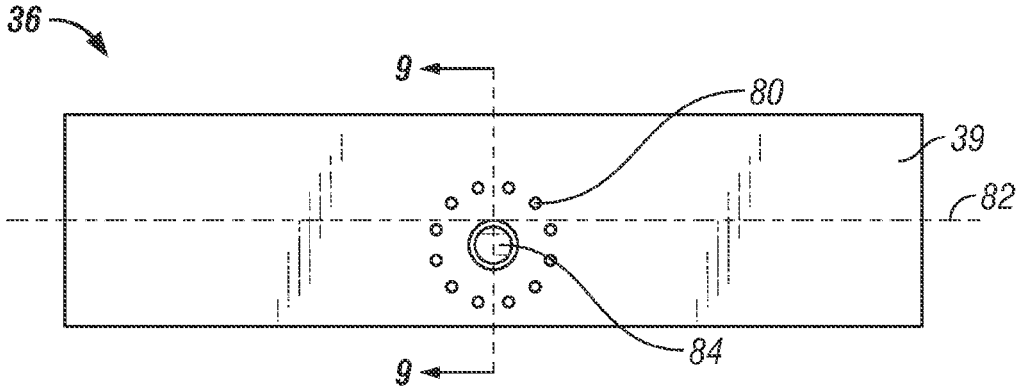
FIG. 8 is a back schematic view of the collection block illustrated in FIG. 6.
Figure 9:
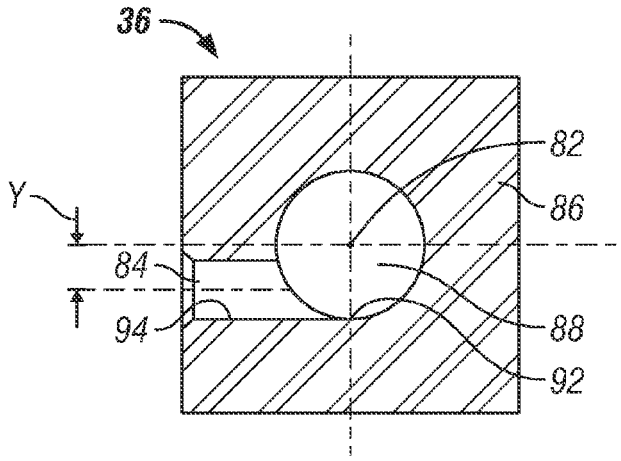
FIG. 9 is a side cross-sectional schematic view of the collection block illustrated in FIG. 8.

FIG. 8 is a back schematic view of the collection block illustrated in FIG. 6. FIG. 9 is a side cross-sectional schematic view of the collection block illustrated in FIG. 8. The figures will be described in conjunction with each other. An inlet 84 can be disposed on a face 39 of the collection block 36 that is distal from the face 37 of the collection block with the inlets 38. The inlet 84 can have an attachment means 80 for coupling a line thereto. The inlet 84 could be used to couple the supply line to the collection block, such as shown in FIG. 4C. The inlet 84 can be offset from the longitudinal axis 82 of the longitudinal bore 88 of the collection block by an offset distance Y in a similar manner as the offset X of the inlets 38. Thus, the portion of the wall 94 of the inlet 84 that is distal from the centerline 82 can tangentially intersect the longitudinal bore 88 in the collection block.

Figure 10:
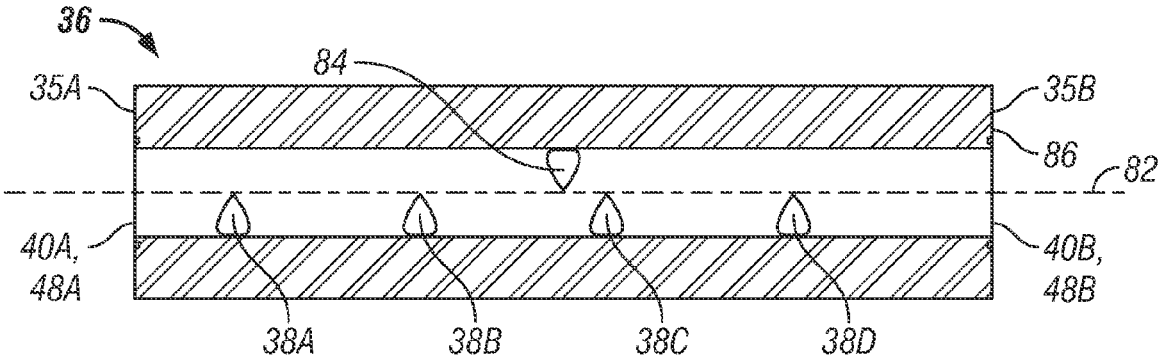
FIG. 10 is a longitudinal cross-sectional schematic view of the collection block illustrated in FIGS. 5-9 through the collection block bore centerline shown in FIG. 6.

FIG. 10 is a longitudinal cross-sectional schematic view of the collection block illustrated in FIGS. 5-9 through the collection block bore centerline shown in FIG. 6. The collection block 36 includes the longitudinal bore 88 having a longitudinal centerline 82. Due to the offsets of the inlets 38 and the inlet 84, described above, the cross-sectional view from FIG. 6 shows the changing profiles of the inlets into the bore 88 as they tangentially merge into the bore 88. The resulting teardrop shaped profile shown in FIG. 10 helps illustrate the ease of flow transition from the inlets into the bore 88.

The end of the collection block 36 includes the outlet 40A, 48A described in FIGS. 3 and 4 on one end, and the outlet 40B, 48B on the second end distal from the first end. Thus, the incoming flow through the inlets 38 are aggregated in the bore 88 and allowed to flow out of the collection block 36 through the outlets 40, 48 as described above.

Other and further embodiments utilizing one or more aspects of the invention described above can be devised without departing from the spirit of the invention. For example, the number of outlets or inlets can vary on the collection block from one to many, the shape of the collection block can vary, and the direction and orientation of the inlets and outlets can vary. Other variations in the system are possible.

Further, the various methods and embodiments of the system can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A fracturing system for oilfield applications on a well, comprising:

a first collection block configured for coupling with a plurality of flow lines in a fracturing system and having a first face and a second face disposed at an angle to the first face and a first end and a second end with a longitudinal bore through the collection block between the ends, the longitudinal bore establishing a longitudinal centerline, the first collection block further having at least one outlet fluidicly coupled to the longitudinal bore, and one or more first inlets having an inlet bore disposed through the first face to intersect the longitudinal bore and the inlet bore being offset by a distance from the centerline to cause an outer periphery of the inlet bore to tangentially intersect an outer periphery of the longitudinal bore.

2. The fracturing system of claim 1, wherein the first collection block has a first row of first inlets and a second row of first inlets, the first row of first inlets being disposed below the longitudinal centerline and the second row of first inlets being disposed above the longitudinal centerline, each row being offset by a distance from the centerline so that one or more of the inlet bores of the first inlets tangentially intersect the longitudinal bore.

3. The fracturing system of claim 1, wherein the first collection block comprises at least one outlet on at least one of the ends.

4. The fracturing system of claim 1, further comprising a second inlet disposed through the second face that intersects the longitudinal bore.

5. The fracturing system of claim 4, wherein the second inlet comprises a bore disposed through the second face to intersect the longitudinal bore and is offset by a distance from the centerline to cause the inlet bore to tangentially intersect the longitudinal bore.

6. The fracturing system of claim 4, wherein the second inlet is disposed through the second face that is opposite from the first face and intersects the longitudinal bore tangentially opposite from the first inlets.

7. The fracturing system of claim 1, wherein the first inlets of the first collection block are coupled to a plurality of supply lines and the supply lines are adapted to be removably coupled to one or more trucks having one or more supplies of fracturing fluid.

8. The fracturing system of claim 1, wherein the first collection block is mounted to a collection module remote from a well and wherein the first collection block comprises one or more outlets that are fluidicly coupled to the well.

9. The fracturing system of claim 8, further comprising a second collection block having a first face and a second face disposed at an angle to the first face and a first end and a second end with a longitudinal bore through the second collection block between the ends, the longitudinal bore establishing a longitudinal centerline, the second collection block further having at least one outlet fluidicly coupled to the longitudinal bore, and one or more first inlets having an inlet bore disposed through the first face to intersect the longitudinal bore, the outlet of the second collection block fluidicly coupled to the well.

10. The fracturing system of claim 9, wherein the first inlets of the second collection block are offset by a distance from the centerline so that one or more of the inlet bores of the first inlets tangentially intersect the longitudinal bore of the second collection block.

11. A fracturing system for oilfield applications on a well, comprising:

a first collection block configured for coupling with a plurality of flow lines in a fracturing system and having a first face and a second face and a first end and a second end with a longitudinal bore through the first collection block between the ends, the longitudinal bore establishing a longitudinal centerline, the first collection block having at least one outlet fluidicly coupled to the longitudinal bore, and one or more first inlets having an outer periphery of an inlet bore disposed through the first face to tangentially intersect an outer periphery of the longitudinal bore; and the first collection block further having a second inlet disposed through the second face that intersects the longitudinal bore.

12. The fracturing system of claim 11, wherein the first collection block has a first row of first inlets and a second row of first inlets, the first row of first inlets being disposed below the longitudinal centerline and the second row of first inlets being disposed above the longitudinal centerline, each row being offset by a distance from the centerline so that one or more of the inlet bores of the first inlets tangentially intersect the longitudinal bore.

13. The fracturing system of claim 11, wherein the second inlet of the first collection block comprises a bore disposed through the second face to intersect the longitudinal bore and is offset by a distance from the centerline to cause the inlet bore to tangentially intersect the longitudinal bore.

14. The fracturing system of claim 11, wherein the second face is opposite from the first face and the second inlet intersects the longitudinal bore tangentially opposite from the first inlets.

* * * * *